United States Patent [19]

Tabachnik

[11] Patent Number: 4,468,146

[45] Date of Patent: Aug. 28, 1984

[54] CRAYON HOLDER

[75] Inventor: Joel B. Tabachnik, New York, N.Y.

[73] Assignee: Talbot Toys Ltd., Wanchai, Hong Kong

[21] Appl. No.: 377,639

[22] Filed: May 13, 1982

[51] Int. Cl.[3] ..... B43K 21/22; B43K 23/00; B43K 23/04

[52] U.S. Cl. ..... 401/88; 401/6; 401/92; 401/116; D19/42

[58] Field of Search ..... 401/92, 93, 94, 116, 401/6, 88; D19/42

[56] References Cited

U.S. PATENT DOCUMENTS

| | | | |
|---|---|---|---|
| D. 222,401 | 10/1971 | Feuer | D19/42 |
| 290,988 | 12/1883 | Johnson . | |
| 549,137 | 11/1895 | Kiretchjian . | |
| 848,531 | 3/1907 | Baur | 401/93 |
| 2,262,649 | 11/1941 | Ponath | 401/93 |
| 3,510,949 | 5/1970 | Christy | 401/6 X |

FOREIGN PATENT DOCUMENTS

| | | | |
|---|---|---|---|
| 1209911 | 1/1966 | Fed. Rep. of Germany | 401/93 |
| 606124 | 6/1926 | France | 401/88 |
| 337498 | 11/1930 | United Kingdom | 401/93 |

OTHER PUBLICATIONS

"What's Kusan '82?" , Playthings, Mar. 1982, p. 13.

*Primary Examiner*—Steven A. Bratlie

*Attorney, Agent, or Firm*—Panitch, Schwarze, Jacobs & Nadel

[57] ABSTRACT

The crayon holder includes a hollow body telescoped with respect to a collet member having jaws at one end. The collet member at a location remote from the jaws is threaded to a cylindrical portion of the body. A sleeve is telescoped over each of said body and collet member. Cooperating structure is provided on the body and sleeve to facilitate rotation of the sleeve without moving the sleeve in a longitudinal direction. The sleeve has a tapered portion for camming said jaws inwardly. A key on the sleeve cooperates with a groove on said collet member for rotating the collet member and moving it longitudinally relative to the sleeve as the sleeve is rotated about its longitudinal axis.

1 Claim, 4 Drawing Figures

FIG. 1
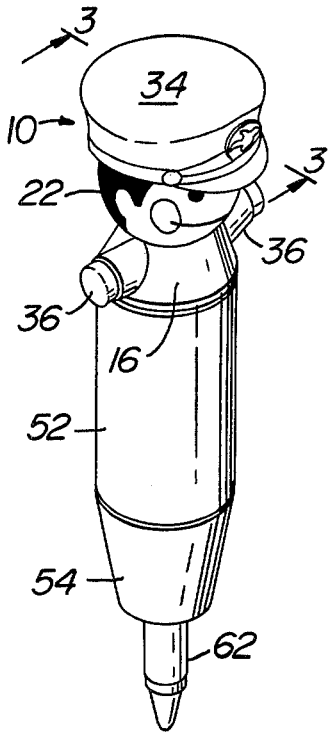
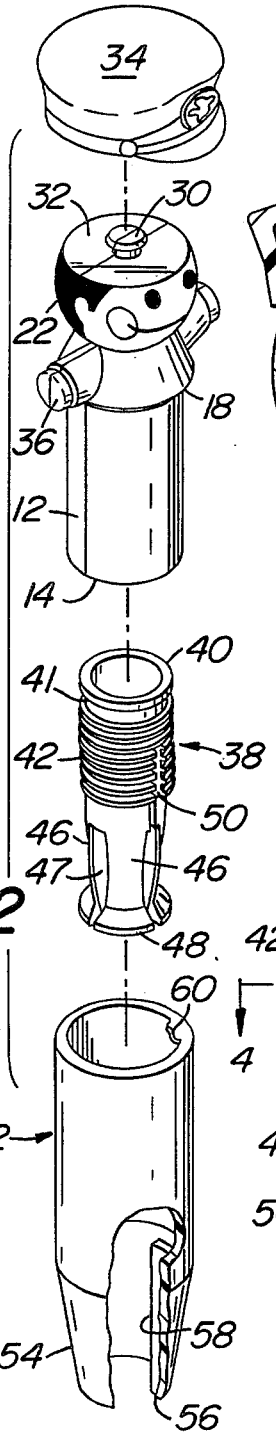
FIG. 2
FIG. 3
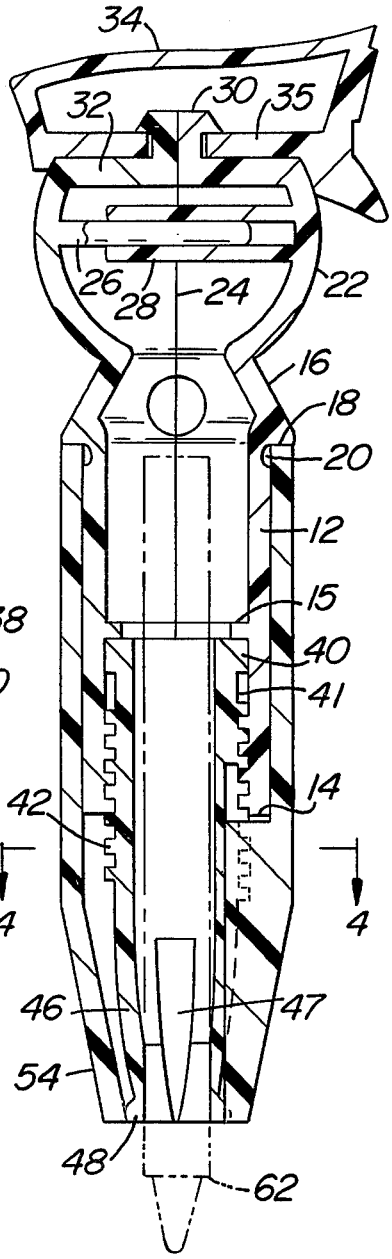
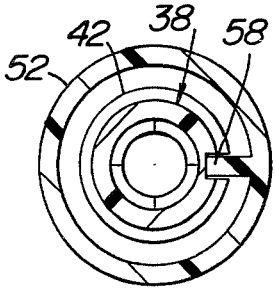
FIG. 4

CRAYON HOLDER

BACKGROUND

There is a need for a simple and inexpensive crayon holder designed especially for small children's hands. The crayon holder should be adjustable and preferably should be capable of standing up when there is no crayon in the holder.

SUMMARY OF THE INVENTION

The crayon holder of the present invention includes a hollow body having a cylindrical portion telescoped relative to a collet member having jaws at one end. The collet member at a location remote from the jaws is threaded to the cylindrical portion of the body. A sleeve is telescoped over each of said collet member and said cylindrical body portion.

Mating means are provided on said body and sleeve to facilitate rotation of the sleeve about its longitudinal axis relative to said cylindrical body portion without moving the sleeve in a longitudinal direction. The sleeve has a tapered portion for camming said jaws inwardly. Means are provided for keying said sleeve to said collet member for moving said collet member and jaws longitudinally relative to said sleeve as the sleeve is rotated about its longitudinal axis.

In the preferred embodiment of the present invention, the upper end of the body is connected to a simulated neck and head. A cap is attached to the top of the head. Simulated arm stubs extend from opposite sides of the neck.

It is an object of the present invention to provide a crayon holder especially designed for small children's hands while being adjustable, attractive, simple to manipulate, and capable of standing up.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a crayon holder in accordance with the present invention.

FIG. 2 is an exploded perspective view, partially in section, of the components of the crayon holder.

FIG. 3 is a sectional view taken along the line 3—3 in FIG. 1 but on an enlarged scale.

FIG. 4 is a sectional view taken along the line 4—4 in FIG. 3.

DETAILED DESCRIPTION

Referring to the drawings in detail, wherein like numerals indicate like elements, there is shown a crayon holder in accordance with the present invention designated generally as 10. The crayon holder 10 includes a body having a cylindrical portion designated 12 with one end of said cylindrical portion designated 14. A limit stop 15 extends radially inwardly from the cylindrical portion 12 intermediate its length. The upper end of the cylindrical portion 12 is connected to a truncated neck 16 having a shoulder 18 at the lower end thereof and extending radially outwardly from the periphery of the cylindrical body portion 12. Coextensive with the shoulder 18 is a groove 20 extending around the cylindrical body portion 12.

The upper end of the truncated neck 16 is connected to a spherical head 22 having a flat top wall 32. The cylindrical body portion 12 is preferably comprised of two halves joined together along a parting line 24. For retaining the cylindrical body portion halves together, there is provided a pin 26 on one body half which is telescoped into a complimentary cylindrical socket 28 on the other body half with a force fit.

The top wall 32 has an integral detent 30 snap-fitted through a hole in the bottom wall 35 of the hollow cap or hat 34. Simulated arm stubs 36 project from the opposite sides of the neck 16. A simulated face may be painted on the head 22 as shown.

The cylindrical body 12 constitutes the first major component of the crayon holder 10. The second major component is the collet member 38 which is best shown in FIG. 2. The collet member 38 has a limit stop 40 defined by a radially outwardly extending groove at the upper end thereof. Threads 42 are provided on a portion of the outer periphery of the collet member 38 and are spaced from the limit stop 40 by a gap 41. Threads 42 mesh with complimentary threads on cylindrical body portion 12. The lower half of the collet member 38 includes a plurality of jaws 46 spaced from one another by openings 47. The lower end or terminal end of the jaws 46 include radially outwardly extending cams 48. Most of the threads 42 are interrupted by a longitudinally extending slot or keyway 50.

The third major component of the crayon holder 10 is the sleeve 52. Sleeve 52 has a cylindrical upper portion and an inwardly tapered end portion 54 terminating at the open end 56. A key 58 projects radially inwardly on the inner surface of the tapered portion 54. Key 58 is also tapered whereby the extent of its inward projection at the upper end is greater than the extent its projects inwardly at the lower end adjacent the open end 56. At its upper end, the sleeve 52 has a radially inwardly extending projection 60 which is adapted to snap into the groove 20 on the cylindrical body portion 12.

Sleeve 52 may be removed from the cylindrical body portion 12 by applying sufficient pressure in an axial direction so as to remove the projection 60 from the groove 20. In a preferred embodiment of the present invention, the total height of the crayon holder 10 is approximately 12.7 centimeters tall. The cylindrical body portion 12 has a diameter of about 2 centimeters. Sleeve 52 has an outer diameter of about 2.5 centimeters and a length of about 7 centimeters. The outer diameter of the sleeve at the open end 56 is slightly less than 2 centimeters whereby the entire crayon holder 10 may stand on the open end in an upright position when the jaws 46 have been withdrawn into the sleeve as shown in FIG. 3.

In use, sleeve 52 is rotated but does not move in a longitudinal direction since the projection 60 is captured in the groove 20. Since the sleeve 52 is keyed to the collet member 38, collet member 38 will rotate relative to the body portion 12 and move longitudinally. With the appropriate direction of rotation of sleeve 52, the jaws 46 will move downwardly and through the open end 56 so as to facilitate reception of a crayon 62. Rotation in the opposite direction will cause the collet member 38 to move upwardly until the cams 48 contact the inner surface of the tapered sleeve portion 54 and thereby cause the jaws 46 to embrace and retain the crayon 62. The vertical traverse of the collet member 38 is quite short and is defined by limit stop 15 at one end and the first thread on the inner surface of the cylindrical body portion 12 at the other end. Thus, the total advance of the collet member is defined by two or three threads.

All components of the crayon holder 10 are preferably made from a polymeric plastic material. The color of the plastic material may be color coded so as to match the color of a particular crayon. Different type hats may be substituted for hat 34 whereby the crayon holder simulates a well known person such as a policeman, fireman, doctor, nurse, etc. The color of the plastic used in making the crayon holder 10 may be color coded to the color of the clothing simulated person such as white in connection with a simulated nurse, red in connection with a simulated fireman, etc.

The present invention may be embodied in other specific forms without departing from the spirit or essential attributes thereof and, accordingly, reference should be made to the appended claims, rather than to the foregoing specification, as indicating the scope of the invention.

I claim:

1. A crayon holder comprising:

a hollow generally cylindrical body;

a generally cylindrical collet member having jaws at one longitudinal end capable of flexing radially inwardly and outwardly, said collet member being telescoped and threaded to said body at the other longitudinal end;

a cylindrical sleeve telescoped over at least a portion of each of said collet member and said body, said body including a simulated neck which is connected to a simulated head having a hat, and simulated arm stubs projecting from opposite sides of said neck beyond the circumference of the head and the sleeve, said arm stubs being substantially perpendicular to said body, the lower end of said neck having a radially outwardly extending shoulder acting as a longitudinal limit stop for said sleeve;

means including an axially extending keyway on the outer periphery of said collet member extending through at least a portion of said threads and a key on the inner periphery of said sleeve cooperative with said keyway for moving said collet member longitudinally relative to said sleeve as said body is rotated relative to the sleeve; and a groove on said body coextensive with said shoulder for receiving a projection on said sleeve to facilitate rotation of the body relative to the sleeve without moving the sleeve in a longitudinal direction, said sleeve having a tapered portion at one end for cooperating with outwardly extending cams on said jaws for camming said jaws inwardly, said jaws having an end surface cooperating with an end surface at the tapered end of the sleeve to provide a stable support area substantially equal to the circumference of the holder so that the crayon holder may stand in an upright vertical position on a support surface when the jaws are positioned inside said sleeve.

* * * * *